US010865517B2

(12) United States Patent
Füser et al.

(10) Patent No.: US 10,865,517 B2
(45) Date of Patent: Dec. 15, 2020

(54) COLORING PRODUCT, IN PARTICULAR FOR DYEING OR REFRESHING DYES IN TEXTILE MATERIALS WITH INDIGO DYES

(71) Applicant: BRAUNS-HEITMANN GMBH & CO. KG, Warburg (DE)

(72) Inventors: Katja Füser, Rüthen (DE); Uwe Gibbels, Warburg (DE)

(73) Assignee: BRAUNS-HEITMANN GMBH & CO. KG, Warburg (DE)

( * ) Notice: Subject to any disclaimer, the term of this patent is extended or adjusted under 35 U.S.C. 154(b) by 0 days.

(21) Appl. No.: 16/681,155

(22) Filed: Nov. 12, 2019

(65) Prior Publication Data

US 2020/0080260 A1 Mar. 12, 2020

Related U.S. Application Data

(63) Continuation of application No. PCT/EP2018/061347, filed on May 3, 2018.

(30) Foreign Application Priority Data

May 12, 2017 (DE) ..... 10 2017 110 330

(51) Int. Cl.

| | |
|---|---|
| ***D06P 1/00*** | (2006.01) |
| ***D06P 1/22*** | (2006.01) |
| ***C11D 3/42*** | (2006.01) |
| ***C11D 17/04*** | (2006.01) |
| ***D06P 1/50*** | (2006.01) |
| ***D06P 1/52*** | (2006.01) |

(52) U.S. Cl.

CPC ..... *D06P 1/228* (2013.01); *C11D 3/42* (2013.01); *C11D 17/041* (2013.01); *D06P 1/50* (2013.01); *D06P 1/5271* (2013.01)

(58) Field of Classification Search

CPC ..... D06P 1/228; D06P 1/22; D06P 1/0016; D06P 3/82; D06P 3/62; D06P 1/44

USPC ..... 8/653, 441

See application file for complete search history.

(56) References Cited

FOREIGN PATENT DOCUMENTS

| | | | |
|---|---|---|---|
| DE | 10360842 | 12/2004 | |
| DE | 102004051582 | 4/2006 | |
| DE | 102015218190 | 3/2017 | |
| DE | 102015119949 | 5/2017 | |
| JP | H06287870 | 10/1994 | |
| JP | H09132879 | 5/1997 | |
| JP | 3113218 | 9/2000 | |
| WO | 2017/050646 | 3/2017 | |
| WO | WO 2017/050646 A1 * | 3/2017 | ..... D06P 1/22 |

OTHER PUBLICATIONS

English translation dated (Jul. 30, 2020) of the Patent WO 2017/050646 A1.*

International Search Report for International Application PCT/EP2018/061347, dated Jul. 23, 2018.

* cited by examiner

*Primary Examiner* — Eisa B Elhilo

(74) *Attorney, Agent, or Firm* — Burris Law, PLLC

(57) ABSTRACT

A dye-releasing product for dyeing of or for refreshing of dyeing in textile materials is provided. The dye-releasing product includes a flat, cloth-like carrier material, and at least one coating applied onto the carrier material. At least one indigoid dye in its oxidized form is encompassed by the coating. The coating contains at least one binding agent for the at least one indigoid dye such that the at least one indigoid dye is released in an aqueous solution with a temperature equal to or greater than 20° C. that is, the coating is soluble, at least in part from the flat, cloth-like carrier material, which is added to the textile material to be dyed or whose dyeing is to be refreshed in a washing process.

20 Claims, No Drawings

COLORING PRODUCT, IN PARTICULAR FOR DYEING OR REFRESHING DYES IN TEXTILE MATERIALS WITH INDIGO DYES

CROSS-REFERENCE TO RELATED APPLICATIONS

This application is a continuation of International Application No. PCT/EP2018/061347, filed on May 3, 2018, which claims priority to and the benefit of DE 10 2017 110 330.9, filed on May 12, 2017. The disclosures of the above applications are incorporated herein by reference.

FIELD

The present disclosure relates to a dye-releasing product, in particular for dyeing of or for refreshing of dyes in textile materials, in particular of jeans or denim materials.

BACKGROUND

The statements in this section merely provide background information related to the present disclosure and may not constitute prior art.

Textile products are known in the form of cloths, which prevent a graying of white or bright laundry, meaning textile, soiled materials. Textile products of this kind of feature, for example, cationic resins or similar-acting substances, which in an interplay with additional substances inhibit a graying of laundry even after repeated washing processes.

In the case of darker laundry, in particular blue or red laundry articles, in particular those made of jean or denim materials, even after repeated washing processes, these items can also fade out slowly. In this regard, colored laundry agents are known, which help somewhat toward inhibiting the fading of dark laundry. Dark laundry agents of this kind are used in standard liquid laundry agents for washing, in particular in washing machines. However, the operation of known laundry agents for colored laundry available on the market is not such that a fading, especially of colored laundry, can be retarded permanently.

Patent DE 103 60 842 A1 discloses a laundry detergent system with delayed dyeing effect with products containing shaped bodies with delayed dye release when applied, wherein the shaped bodies and/or their external shaped body casing which dissolves in use, comprises at least one water-soluble thermoplastic polymer, at least one ionic salt that does not complex the polymer; at least one textile-dyeing agent, wherein the dyeing agent features at least two ionic groups that reversibly complex the polymer; and the dyeing agent has a textile-dyeing and/or textile-dye refreshing effect, and at least one dye-adsorbing particulate carrier. The particulate carrier material can be zeolite.

WO 2017/050646 A1 discloses a method for dyeing of textile fabrics or ready-made textiles which makes it possible to imitate denim-like surface features on textile fabrics or ready-made textiles. JP H09 132879 A discloses the dyeing of textile products made of polyester using evaporated indigo. DE 10 2015 218 190 A1 discloses a composition containing a surfactant for the treatment of textiles with dye. JP H06 287870 A pertains to a method for wet transfer pressure with a resin. JP 3 113218 B2 discloses an interior container and an exterior container comprising indigo. DE 10 2004 051 582 A1 discloses the dyeing of cellulose-containing textile material by indigo in non-reduced form by means of sublimation/evaporation.

In the case of laundry articles made of jeans or denim material, such materials often display a unique or inherent character which would be lost after dyeing with a standard blue dyeing agent, for example. An article of jeans laundry dyed accordingly would have the character of blue work pants rather than the jeans character.

The present disclosure addresses these issues of dyeing textile materials, along with other issues related to repeated washing of textile materials.

SUMMARY

In one form of the present disclosure, a dye-releasing product for dyeing of or for refreshing of dyes in textile materials, for example in a washing machine, is provided. The dye-releasing product comprises a flat, cloth-like carrier material, at least one coating applied onto the carrier material and also at least one indigoid dye in its oxidized form encompassed by the coating, wherein the coating additionally comprises at least one binding agent for the at least one dye so that the at least one dye can be released beginning at a temperature of about 20° C. in an aqueous solution, wherein the coating is soluble at least in part from the flat carrier material, which is added to the textile material which is to be dyed or whose dyeing is to be refreshed. As used herein, the phrase "indigoid dyes" or the term "dyes" refers to an indigoid dye in oxidized form unless otherwise noted. Also, the phrase "flat carrier material" or "carrier material" as used herein refers to a flat, cloth-like material. The dye-releasing product, according to the present disclosure, can be used for dyeing of textile materials, and/or for the refreshing of dye in textile materials. Textile materials in accordance with the present disclosure are in particular those which are produced from cotton, natural fibers or polyamides, or mixtures of these mentioned materials, for example jeans or denim materials. Denim materials are distinguished in particular in that either only the warp threads or only the weft threads are dyed. The dye-releasing product, according to the present disclosure, in one form is not a washing agent in the sense that it cleans laundry. Rather, it dyes the laundry and/or rather refreshes an existing dye on or in textile materials in the laundry.

It should be understood that using standard dyeing agents, for example a blue dyeing agent on a blue jeans laundry article, to refresh or to dye it, results in a uniform dyeing result and the jeans character is lost. A refreshing of dyeing within the meaning of the present disclosure is present when a fading of dark, in particular of jeans laundry is inhibited, that is, the fading after a repeated washing of the involved textile materials is delayed or even a fading is stopped entirely, or rather a faded laundry article is again made more color intensive. In accordance with the teachings of the present disclosure, the dye-releasing product is free of dye absorbers, e.g. free of polyvinyl pyrrolidones with dye-absorbing effects or properties.

Washing tests with the product, according to this disclosure, equipped with dark and/or blue or red indigoid dye or mixtures of dye, have shown that even after twenty washings of dark and/or jeans textiles, the fading of the laundry articles is reduced or even stopped entirely, whereas in a comparison test after twenty washings of blue or red jeans textiles without addition of the dye-releasing product, a definite fading is established or observed.

Further areas of applicability will become apparent from the description provided herein. It should be understood that the description and specific examples are intended for purposes of illustration only and are not intended to limit the scope of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features.

The product, according to the present disclosure, comprises a flat, cloth-like carrier material and a coating applied thereon. In this coating, the at least one indigoid dye is present in oxidized form. The flat, cloth-like carrier material can also be viewed as a dyeing cloth. The size of the flat carrier material can be selected as desired, and the quantity of the applied coating, including of the at least one dye encompassed therein, can be selected as a function of the size of the carrier. For example, sizes for the flat carrier material of 10×10 cm or 13.5×19.5 cm are possible. However, other sizes and shapes of the flat carrier material are included within the teachings of the present disclosure. The quantity of the coating on dyeing cloths of this size (i.e., 10×10 cm or 13.5×19.5 cm) can be in a range of about 200 mg up to about 7,000 mg, for example in a range of about 350 mg up to about 2,000 mg. The coating present on the flat carrier material contains quantities of the at least one dye in a range from about 80 mg, for example of about 100 mg, or up to about 1,000 mg. In some variations of the present disclosure the flat carrier material contains a range from about 110 mg up to about 600 mg of the at least one dye. In one form of the present disclosure, the product appears as very light or rather, white, depending on the used flat carrier material, instead of having a dark, in particular blue or red coloration, after the product is removed from a washing machine, and thus the actual color of the flat carrier material is clearly visible. In this manner the user has direct feedback regarding the effect of the product. This is because the coating applied onto the flat carrier material dissolves in use, and at least partly releases the dye.

In at least one form of the present disclosure, the coating comprises at least one binder for the at least one dye, so that the at least one dye can be dispensed in an aqueous solution, starting from a temperature of about 20° C. The release and/or dispensing of the at least one dye takes place in that the coating is at least partly loosened from the flat carrier material in a washing process, so that the binding agent is also at least partly released from the flat carrier material. Due to the release or dispensing of the at least one dye, after a washing process a bright, for example when using a white-colored flat carrier material, a white or nearly white, consumed product is obtained, which directly indicates to the user that the product has worked and deployed its effect.

In some variations of the present disclosure, at least one dye is released in a temperature range from about 25° C. up to about 95° C., for example in a temperature range from about 30° C. up to about 65° C., in an aqueous solution. In at least one variation the aqueous solution is alkaline. In such a variation the aqueous solution has a pH-value in a range from about 7 up to about 14, for example a range from about 7.5 up to about 13. In some variations, the aqueous solution contains a washing agent, for example a powder washing agent and the coating is designed such that when the user places the dye-releasing product into the user's hand in order, for example, to set the product into a washing machine to perform a washing process, the coating will not detach from the flat carrier material and in particular the at least one dye will not be transferred onto the user's hand. The coating on the at least one flat carrier material can be one layer or multiple layers, for example, two layers or three layers, and can be applied, for example with a rake, by spray or with a dyeing machine onto the flat material. In the case of a multi-layer coating, the quantity of the dye on the flat carrier material can be increased, so that the quantity of the dye on the material can be increased in one production process. In addition, the coating can be provided on one or on both sides of the flat carrier material. In one variation of the present disclosure the coating is applied only onto one side of the flat carrier material. The coating can be supplied, for example, in the form of a design, for example, of a company logo or similar design.

Non-limiting examples of the at least one binding agent include natural and/or synthetic resins, gum arabic, guar gum, gelatins, dextrins, agar agar, alginic acid, alginates, carrageenan, albumin, gellan gum, carob bean gum, pectin, modified cellulose, starches, modified starches, and/or xanthan gum. Other non-limiting examples of the at least one binding agent include synthetic resin-encompassing polyesters, polyvinyl acetates, polyacrylates, polyclycols [sic], polyvinyl alcohols and/or polyvinyl pyrrolidones (PVP) and/or mixtures of the stated polymers, wherein the named polymers do not feature any dye-collection effects or properties. In some variations the synthetic resins are non-ionic or anion active. Also, gum arabic is quite suitable as binding agent. In at least one variation, the binding agent is selected from a group comprising polyesters and/or polyvinyl acetates, which are present as aqueous dispersions, and also are non-ionogenic. In one variation the binding agent is formed from a mixture of a polyvinyl acetate and a polyester.

In some variations the at least one binding agent is present in an amount in a range from about 1 wt-% to 50 wt-% relative to the total amount of the coating. For example when the at least one binding agent is selected from the group of natural substances, such as gum arabic, gelatins, gellan, etc., it is present in an amount in a range from about 1.5 wt-% up to about 10 wt-%. In at least one variation when the at least one binding agent is selected from the group of natural substances, such as gum arabic, gelatins, gellan, etc., it is present in an amount in a range from about 2.2 wt-% up to about 6 wt-%, relative to the total amount of the coating. In some variations the at least one binding agent is selected from a group of natural and/or synthetic resins, for example selected from the synthetic resins, and even in mixtures thereof, the at least one binding agent is present in an amount in a range from about 2.5 wt-% to about 4 wt-%, up to about 49 wt-%, for example in an amount in a range from about 8 wt-% up to about 40 wt-%, relative to the total amount of the coating. In some variations of the present disclosure at least two binding agents are present in the coating and each of them is present in the coating in an amount in a range from about 2 wt-% up to about 35 wt-%, for example in an amount in a range up to about 29 wt-%, relative to the total amount of the coating. In at least one variation a polyester and a polyvinyl acetate are used as binding agents, and the polyester is present in an amount in a range from about 10 wt-%, for example from about 15 wt-% up to about 35 wt-%, or in an amount in a range from about 12 wt-%, for example about 20 wt-%, up to about 32 wt-%, relative to the total amount of the coating, and the polyvinyl acetate is present in an amount in a range from about 4 wt-% up to about 20 wt-%, for example in a range from about 5 wt-% up to about 18 wt-%, relative to the total amount of the coating.

In one form of the present disclosure the coating comprises at least two binding agents, in particular those as described above. In some variations a first binding agent, for example a polyvinyl acetate, features a pH-value in a range from about 3.5 up to about 5.5, and a second binding agent, for example a polyester, features a pH-value in a range from about 5.6 up to about 9. In at least one variation the at least one binding agent is non-ionogenic.

In one form of the present disclosure, the at least one indigoid dye in oxidized form is selected from a group comprising indigo, indigo-ruby, indigo carmine, purple and their derivates. Sample derivates are brilliant indigo 4B (Cibablau 2B) or Thioindigo. In at least one variation the indigoid dye is Indigo. Indigo is also known by its chemical name as 2,2' Bis(2,3-dihydro-3-oxoindolylidene). The indigoid dyes in oxidized form as used according to the present disclosure are characterized in that they are slightly, to very slightly, soluble in water. In some variations the indigoid dyes have a granular structure and may be designated as dye pigments. Accordingly, indigoid dyes display pigment-like properties. It should be understood that the above mentioned dyes are also known as vat dyes, and these dyes are initially reduced and then applied onto the textile material and are finally oxidized again. In this regard, indigo is first converted into the pale yellow indigo white (reduced form) and subsequently oxidized back into blue indigo. In some variations the indigoid dyes in oxidized form used according to the teachings of the present disclosure are non-ionogenic. In at least one variation the indigoid dyes used herein are not functionalized, for example not functionalized with ionic groups and/or do not display any ionic groups. Also, in some variations the indigoid dyes do not react with other constituents of the dye-releasing product disclosed herein. Surprisingly, it has been found that when using just the oxidized form in the coating of the dye-releasing product according to the teachings of the present disclosure, very good results are obtained relative to the refreshing of dyes and/or dyeing of laundry articles such as jean laundry articles in blue or red coloration, and these articles retain their typical jeans character.

In one form of the present disclosure, the at least one indigoid dye in oxidized form is present in the coating in an amount in a range from about 30 wt-%, for example about 40 wt-%, up to about 98 wt-%. In some variations, the at least one indigoid dye in oxidized form is present in the coating in an amount in a range from about 45 wt-%, for example from about 50 wt-% up to about 98% wt-%, or up to about 70 wt-%, each relative to the total amount of the coating. Provided a natural binding agent such as gum arabic, gelatins, gellan or similar is used as a binding agent, but no natural and/or synthetic resin is employed, then the quantity of the at least one employed dye can be present in a range from about 70 wt-% up to about 98 wt-%, for example in a range from about 78 wt-% up to about 97.8 wt-%, each relative to the total amount of the coating. In variations where the at least one binding agent is selected from a group comprising natural and/or synthetic resins, for example synthetic resins, especially those that have been described above, even in combination with each other, the at least one dye is present in the coating in an amount in a range from about 30 wt-% to about 48 wt-%, up to about 80 wt-%, for example in an amount in a range from about 52 wt-% up to about 70 wt-%, each relative to the total amount of the coating.

In one form of the present disclosure, the at least one indigoid dye has a pH-value in a range from about 6 up to about 11, for example in a range from about 6.5 up to about 8.5. In some variations the at least one indigoid dye in oxidized form is present in pigment form, that is, granular. In such variations the at least one indigoid dye in oxidized form can have a particle size in a range of ≤1.5 μm, for example a particle size in a range of 0.05 μm up to about 1.5 μm or up to about 1 μm. If the indigoid dye is present in the above-mentioned sizes or size ranges, especially in a mixture with the at least one binding agent, for example in the form of a coating on a cloth-like carrier material, the dyeing effect or the refreshing of the dye is further improved and even smaller quantities of the dye can be used. In at least one form the at least one indigoid dye in oxidized form is present as a granule in the at least one binding agent and is in the form of a coating on a cloth-like carrier material.

As used herein, the term "about" when used with values or value ranges refers to a tolerance range known to those skilled in the art. In particular, a tolerance range of +/−20%, for example +/−10%, +/−5%, or +/−2% is accepted in regard to the stated values or value ranges. The values and/or value ranges stated in the present disclosure can thus increase or decrease within the tolerance range stated above without going beyond the bounds of the present disclosure.

In one form of the present disclosure at least two indigoid dyes are present in the coating. In some variations exactly two dyes are present in the coating. In such a variation the coating can include a blue dye, such as indigo, and a reddish dye, such as indigo carmine. In the case that at least two dyes are present in the coating, then they are each present in the coating in an amount in a range from about 15 wt-% to about 49 wt-%, for example each in an amount in a range from about 25 wt-% up to about 49 wt-%, each relative to the total amount of the coating. If exactly two dyes are present in the coating, in some variations they are present in identical amounts therein. Also, different amounts of at least two indigoid dyes can be present when the binding agent is selected from a group comprising natural and/or synthetic resins, in particular the resins and/or mixtures thereof stated above. In the case that at least one blue dye, for example when exactly one blue indigoid dye is present, for example indigo in oxidized form, then this dye can be present in the coating in an amount in a range from about 28 wt-% up to about 75 wt-%, for example in a range from about 50 wt-% up to about 70 wt-%, each relative to the total amount of the coating.

In a favorable manner, the parameters defined above will mean that no dust will appear on the flat, cloth-like carrier material due to the coating applied thereon, in particular due to the at least one indigoid dye in oxidized form comprising the coating. In particular, in case of kinking or other deforming of the flat carrier material, a depositing of the coating onto the flat carrier material will be dependably inhibited due to the named parameters relating to the dye, and also relating to the binding agent. In an advantageous manner, the binding agent is used, for example in the form disclosed above, to inhibit any depositing of the indigoid dye onto the flat product. Also, any dyeing of the hands of the user can also be thus inhibited, hence, a sufficiently tight adhesion of the indigoid dye onto the flat carrier material can be achieved.

The ratio of the amount of the at least one binding agent to the at least one indigoid dye in the coating on the dye-releasing product according to the present disclosure lies in a range from about 1:1 up to about 1:5, for example in a range from about 1:1.25 up to about 1:3.

The dyeing product according to the present disclosure can additionally comprise at least one thickening agent in the coating. The at least one thickening agent is used in a favorable manner for adjusting the viscosity of the binding agent and/or of the dye, depending on the use thereof. In some variations the at least one thickening agent is chosen from a group comprising polyacrylates, for example those in an aqueous dispersion. In one non-limiting example the polyacrylate is anion-active. In at least one variation the polyacrylate is not an active dye adsorber. In some variations the pH-value of the at least one thickening agent is in a range from about 1.5 up to about 6, for example in a range from about 1.8 up to about 4.5. In at least one variation the at least one thickening agent is present in a range from about 1 wt-% up to 3.5 wt-%, for example up to about 2 wt-%, relative to the total amount of the coating.

In at least one form of the present disclosure, the at least one dye-releasing product contains urea in an amount in a range from about 2 wt-% up to about 30 wt-%, for example in an amount in a range from about 4 wt-% up to about 27 wt-%, each relative to the total amount of the coating in the dye-releasing product. In some variations the purpose of the urea upon application of the coating onto a flat carrier material is to keep the viscosity roughly constant and/or inhibit any after-thickening of the coating mass after application onto the bonded fiber fabric.

The coating of the dye-releasing product, according to the present disclosure, can additionally comprise in an advantageous manner at least one dispersing agent, at least one wetting agent, at least one complex-former and/or at least one antiflocculating agent. These mentioned agents are suitable to make available the at least one indigoid dye in oxidized form in the coating compositions to be produced for the coating such that enhanced dyeing results are obtained and/or the dye can be finely distributed in an aqueous solution. In this regard, the at least one dispersing agent is used expediently. In one form of the present disclosure, however, the dye-releasing product in the coating and also the coating composition according to the disclosure to be described below do not contain any of the aforementioned agents, or in any case only at least one dispersing agent.

According to one form of the present disclosure, the at least one flat carrier material is a bonded fiber fabric. For example, the flat, cloth-like carrier material can be white or features a bright coloration.

In one form of the present disclosure the flat, cloth-like carrier material is produced from fibers that are not directly dyed by the at least one indigoid dye. In some variations the at least one flat carrier material is one that readily releases dyes applied to the carrier material, that is, that it releases well or very well from the carrier material, for example at least partly together with the coating.

In some variations, predominately synthetic fibers are used to form the bonded fiber fabric, for example polymer fibers and/or combinations of natural and synthetic fibers. The flat carrier material features a flexible character, having good grasping properties and can be easily handled by the user. To produce a polymer-based bonded fiber fabric within the meaning of the present disclosure, any particular fiber-forming polymers can be used which, when melted or in solution, display properties that satisfy the conditions desired for fiber spinning. For example, polymers from the group of polyolefins as homopolymers or blends, polyamides, polyesters, decomposable polymers, for example based on polylactic acid or starch, are suitable for producing of these fiber fabrics. Bonded fiber fabrics based on polyolefin can be used for the flat carrier material, for example a viscose polyester fiber fabric cab be used as the flat carrier material. The flat carrier material, and thus the bonded fiber fabric, can be designed as a single layer or multiple layers. Materials designed as a single layer, for example a single layer made of fibers and/or filaments, pile or continuous threads which are produced for example by using a spunbonded method or meltblown method or carding method or a wet spinning method, can be used to produce the flat carrier material. Multiple-layer bonded fiber fabrics can be designed, for example, on a polymer basis, wherein also intermediate layers can be provided, which can be formed predominately or entirely from other fibers than the outer layers, and for example can also be formed from natural or decomposable fibers. Porous film layers can also be used as an alternative to the bonded fiber fabrics as flat carrier materials within the meaning of the present disclosure. Common surface weights of the bonded fiber fabrics or porous film layers to form a flat carrier material are between about 10 $g/m^2$ up to about 200 $g/m^2$, for example in a range between about 25 $g/m^2$ up to about 100 $g/m^2$. Multiple-layer structures can be produced in separate processing steps or in one processing step, for example, in-line. The diameter of the fiber or filament of a bonded fiber fabric preferred for use according to this disclosure can be in a range from less than about 0.001 mm up to more than about 0.2 mm, wherein the fiber cross sections can be designed as round, non-round, for example, elliptical, rectangular, polygonal or multi-lobal, for example trilobal. The fibers and/or filaments can be designed as monofilaments or multiple-component filaments. The bonding of the fibers within this fiber fabric can be achieved by means of thermal bonding and/or by adhesive bonding, for example, by hot-melt adhesive, needling, and water jet solidification, among others.

Both the structure of the fiber cross sections, the thickness and layer structure of the flat carrier material, and also the combination of natural and/or synthetic fibers have an effect in regard to increasing the dye release of the at least one dye and/or of the at least one coating of the invented product. The flat material can also be produced from different materials and can also have, for example, a lamination on one side with a dye-impermeable foil or a film, for example, so that the potential for accidental dyeing of the user during use is reduced. In some variations a viscose polyester-fiber fabric is used with equal fractions of viscose and polyester. However, according to the present disclosure it is also possible that one of the two constituents is present in a greater quantity than the other. Accordingly, in some variations the proportion of viscose in the viscose-polyester bonded fiber fabric can be in a range from about 40 wt-% up to about 50 wt-%; the proportion of polyester can be in a range from about 40 wt-% up to about 60 wt-%, each relative to the total amount of the bonded fiber fabric. The thickness of the flat carrier material resides advantageously in a range between about 0.2 mm and about 1.2 mm, for example in a range between about 0.35 mm and about 0.8 mm. Alternative bonded fiber fabric material can consist, for example, of polyethylene or polypropylene or mixtures thereof.

In at least one form of the present disclosure the flat carrier material cannot be dyed by the at least one indigoid dye. This leads to the effect that after implementation of a washing process, the user of the (for example) washing machine can remove the flat carrier material in its bright or white form, so that the user will immediately have an impression of the effect of the employed invented product.

In one form of the present disclosure the cloth comprising the flat carrier material features a coating which contains about 1 wt-% up to about 3.5 wt-%, for example about 2 wt-% up to about 3 wt-% of gum arabic as binding agent, and about 96 wt-% up to about 98.5 wt-% of at least one indigoid dye, each relative to the total amount of the coating. In some variations the coating on the flat carrier material features about 18 wt-%, for example about 30 wt-%, up to about 46 wt-% of at least one binding agent, for example an amount in a range from about 35 wt-% up to about 44 wt-%, each relative to the total amount of the coating. The at least one binding agent can be selected from among two binding agents, namely one polyester or one polyvinyl acetate, as was described above. A polyester as the binding agent can be present in an amount in a range from about 12 wt-%, for example about 15 wt-%, up to about 35 wt-%, relative to the total amount of the coating. A polyvinyl acetate can be present in the coating in an amount in a range from about 8 wt-% up to about 20 wt-% relative to the total amount of the coating. In this mixture at least one indigoid dye in oxidized form is present in an amount in a range from about 30 wt-%, for example from about 50 wt-%, up to about 70 wt-%, for example in an amount in a range from about 55 wt-% up to about 65 wt-%, relative to the total amount of the coating. In some variations the coating comprises exactly one dye. In other variations the coating comprises exactly two dyes. Moreover, the coating can additionally comprise a thickening agent in an amount in a range from about 5 wt-% up to about 30 wt-%, for example up to about 15 wt-%, relative to the total amount of the coating.

In some variations of the present disclosure the coating on the flat carrier material comprises about 20 wt-% up to about 45 wt-% of at least one binding agent, relative to the total amount of the coating. The at least one binding agent disclosed herein can be formed from a polyester and a polyvinyl acetate. In this regard the polyester can be present in the coating in an amount in a range from about 10 wt-%, for example about 12 wt-%, up to about 35 wt-%, relative to the total amount of the coating, and the polyvinyl acetate can be present in an amount in a range from about 4 wt-%, for example from about 6 wt-%, up to about 20 wt-%, relative to the total amount of the coating. A composition of this kind for the coating can additionally comprise at least one dye in an amount in a range from about 28 wt-%, for example from about 45 wt-%, up to about 80 wt-%, for example in an amount in a range from about 50 wt-% up to about 70 wt-%, each relative to the total amount of the coating. In at least one variation, the coating comprises exactly one dye. In at least one other variation, the coating comprises exactly two dyes. Also, a thickening agent can be added to the quantity described above.

The compositions described above can be applied for example with an air rake onto the flat carrier material, for example a viscose polyester bonded fiber fabric, as described above, by applying corresponding aqueous coating compositions thereon and subsequently drying at 100° C., for example.

In one form of the present disclosure, the liquid coating composition, for example an aqueous one for a flat, cloth-like carrier material for dyeing of or for refreshing of dyes in textile materials comprises at least one indigoid dye in oxidized form and at least one binding agent for the at least one indigoid dye, such that the at least one indigoid dye can be dispensed beginning at a temperature of at least 20° C., for example at a temperature in a range from about 25° C. up to about 95° C., such as at a temperature in a range from about 30° C. up to about 65° C., in an aqueous solution for the dyeing of or refreshing of dyes in textile materials. The above discussion, in connection with the product disclosed herein, also applies in this regard. The coating composition can differ from the coating in that the latter additionally contains at least one solvent. The solvent can be water, but can also be, for example, ethanol, acetone or similar, or mixtures thereof. The coating itself is dry on the cloth, that is, it does not contain any solvent. The dry coating is obtained by a drying step in the production of the product from the liquid, likewise coating composition.

In one form of the present disclosure the coating composition contains at least one indigoid dye in an amount in a range from about 4 wt-%, up to about 50 wt-%, for example in an amount in a range from about 6 wt-% up to about 35 wt-%, for example in a range from about 8 wt-% up to about 20 wt-%, each relative to the total amount of the coating composition. The at least one binding agent can be present in the coating composition in an amount in a range from about 0.2 wt-%, up to about 28 wt-%, for example up to about 20 wt-%, and for example in an amount in a range from about 1 wt-% up to about 12 wt-%, each relative to the total amount of the coating composition. If gum arabic is used in the coating composition, then it can be present in an amount in a range from about 0.2 wt-% up to about 2 wt-%, relative to the total amount of the coating composition. If the at least one binding agent is selected from the group of natural and/or synthetic resins, in particular from the synthetic resins described above in connection with the product, a non-ionic resin can be present in an amount in a range from about 1.8 wt-%, for example from about 2 wt-% up to about 15 wt-%, for example up to about 12 wt-%, such as in an amount in a range from about 2 wt-%, for example from about 2.5 wt-% up to about 10 wt-%, each relative to the total amount of the coating composition. If a polyester is used as the synthetic resin, then it can be present in the coating composition in an amount in a range from about 2.5 wt-% up to about 20 wt-%, for example up to about 10 wt-%, relative to the total amount of the coating composition. If the binding agent is a polyvinyl acetate, then it can be present in the coating composition in an amount in a range from about 1 wt-% up to about 6 wt-% relative to the total amount of the coating composition.

In some variations the coating composition contains at least one thickening agent. In such variations the at least one thickening agent is present in the coating composition in an amount in a range from about 1.5 wt-%, for example from about 6 wt-%, up to about 30 wt-%, for example up to about 18 wt-%, relative to the total amount of the coating composition. In at least one variation the at least one thickening agent is an acrylic resin, for example one in aqueous dispersion, for example one that is anion-active.

In at least one variation the coating composition contains water in an amount in a range from about 35 wt-%, for example from about 40 wt-%, for example about 60 wt-%, up to about 90 wt-%, for example up to about 85 wt-%, relative to the total amount of the coating composition.

Furthermore, the coating composition can contain urea in an amount as has been stated above in connection with the coating. The urea remains entirely in the coating after drying.

In addition, the coating composition can contain other auxiliaries commonly known to one skilled in the art. For example, the coating composition can contain defoaming agents in an amount in a range from about 0.1 wt-% up to about 1 wt-%, for example from about 0.15 wt-%, up to about 0.5 wt-%, each relative to the total amount of the coating composition.

The coating composition is advantageously applied by means of an air rake, but also by any other suitable method, onto the flat carrier material and then dried. The drying can take place at temperatures in a range from about 60° C. up to about 150° C. The viscosity of the coating composition before application onto the at least one flat carrier material can reside in a range from about 2,000 mPa s up to about 10,000 mPa s, measured at 20° C. according to DIN 53019-1:2008.

The present disclosure furthermore also relates to a method for dyeing of or for refreshing of dyes in materials, for example in a washing machine, wherein a product according to the present disclosure, as described above, is added to textile materials in an aqueous solution at a temperature of at least 20° C., for example at a temperature in a range from about 25° C. up to about 95° C., for example at a temperature in a range from about 30° C. up to about 65° C., over a time period of at least 10 minutes, for example over a time period from about 15 minutes up to about 300 minutes, for example over a time period from about 30 minutes up to about 90 minutes.

In some variations of the present disclosure, the aqueous solution additionally features a detergent, in particular a powder detergent. In at least one variation the pH-value of the aqueous solution is in a range from about 7, for example about 9, up to about 13. In some variations of the present disclosure, even a one-time washing process with a dye-releasing product, according to the present disclosure, leads to a refreshing of the coloration in textiles.

The present disclosure also relates to the use of a dye-releasing product, according to the present disclosure, for dyeing of or for refreshing of dyeing in textile materials made of cotton, natural fibers and/or polyamide, for example jeans and/or denim materials, wherein the product is added to the textile material which is to be dyed or whose dyeing is to be refreshed, wherein the coating is soluble at least in part from the flat carrier material in a washing process. The flat carrier material can be a bonded fiber fabric and one that is not produced from the above-stated materials (i.e., cotton, natural fibers and/or polyamide). It is, advantageously, a bonded fiber fabric produced from viscose and/or polyester fibers, in particular a white or light-colored one. The use takes place in that precisely one dye-releasing product, according to the present disclosure, is added to the dyeing mixture or to the dye-refreshing mixture of textile materials, for example into a commercial washing machine.

The present disclosure additionally relates to the use of at least one indigoid dye in oxidized form in a coating of a flat, cloth-like carrier material as described above, for dyeing of or for refreshing of dyes in textile materials, in particular in jeans and/or denim materials, wherein the flat, cloth-like carrier material is added to the mixture of textile materials which is to be dyed or whose dyeing is to be refreshed, wherein the coating is soluble at least in part from the flat carrier material in a washing process. With regard to the used indigoid dyes, the composition of the coating and also the flat, cloth-like carrier material, the reader is additionally referred to the designs and discussion already given in connection with the dye-releasing product according to this disclosure.

These, and additional advantages of the present disclosure, are explained in greater detail based on the following exemplary examples.

A first coating composition was prepared from 83.5 wt-% of water, 16 wt-% of indigo (oxidized form), and 0.5 wt-% of gum arabic. The values in wt-% pertain to the total amount of the coating composition. Gum arabic was first dissolved in some water and then added to the mixture. 6 g of the named mixture was applied onto a bonded fiber fabric as flat carrier material having a size of 13.5 cm×19.5 cm with a surface weight of 50 g/m$^2$ by means of an air rake and the cloth was subsequently dried at 50° C. Thus a coating forms on the flat material which features about 2.6 wt-% gum arabic and about 97.4 wt-% of dye. As bonded fiber fabric, a viscose polyester bonded fiber fabric with a thickness of 0.5 mm was used. It displayed a white color. After addition of the freshly prepared product to a laundry wash of textile, blue jeans (pants) in a commercial washing machine with the addition of a standard amount of a commercially available powdered laundry detergent, the result was essentially no fading of the washed jeans laundry articles, even after twenty washings, while the typical jeans character was retained.

A second coating composition was prepared which contained 80 wt-% of water, 5.5 wt-% of a non-ionogenic binding agent based on polyester, 2.5 wt-% of an additional non-ionogenic binding agent based on a vinylacetate homopolymer, and 12 wt-% of indigo (oxidized form). The values in wt-% pertain to the total amount of the coating composition. This second coating composition was applied by an air rake onto a flat, cloth-like carrier material in the form of a bonded fiber fabric identical to the one that was used for the first coating composition, and having the dimensions of 13.5 cm×19.5 cm and was subsequently dried at 100° C. The amount of the dried coating on the bonded fiber fabric amounted to about 24 g/m$^2$, corresponding roughly to about 0.63 g of dried coating. About 40 wt-% of the two binding agents and about 60 wt-% of the indigo were present in the coating. Twenty loads of blue jeans were washed with each product and the weight of the product was determined before and after the washing. The measured difference turned out to be from 0.5 g to 0.6 g, that means that the coating had essentially completely dissolved from the flat carrier material. The obtained, flat carrier material in the form of the bonded fiber fabric was nearly white. Even after 20 washings, the laundry washed with this product displayed no evidence of fading.

Corresponding to the second coating composition, a third coating composition was prepared with 74.3 wt-% of water, 7.2 wt-% of a first binding agent based on a polyester, 2.5 wt-% of a second binding agent based on a vinylacetate homopolymer and 16 wt-% of the indigoid dye indigo carmine. The values in wt-% pertain to the total amount of the coating composition. This third aqueous coating composition was applied by means of an air rake onto a flat material in the form of a bonded fiber fabric, as was already described above in connection with the first coating composition, and was subsequently dried at 100° C. The coating on the finished, dye-releasing product consisted of about 38 wt-% of the two binding agents and about 62 wt-% of indigo carmine. The amount of the coating on the carrier material amounted to about 1 g. Now using the dye-releasing product obtained from the third coating composition, a total of 20 laundry loads of dark-red laundry were washed in a manner corresponding to that described above for the second coating composition, in a commercially available washing machine and by using a standard powder laundry detergent. The washing took place, as was stated in the preceding cases, at 40° C. using a "colored laundry" washing program. A dark-red pants jeans and a dark-red T-shirt were used as laundry. For example, the commercial powdered laundry detergent used was the Ariel® Color made by Procter & Gamble Service GmbH, Schwalbach am Taunus, Germany. The weight of the bonded fiber fabric was checked before and after the washing using the third coating composition on the 20 loads of laundry washed with the dye-releasing product and it was found that this weight was lighter on average by about 1 g after the washing, which means that essentially the entire coating had been dissolved from the flat carrier material in the form of a bonded fiber fabric. The bonded fiber fabric was nearly white. The dark-red laundry exhibited no evidence of fading.

With the dye-releasing product and the coating composition disclosed herein, and also the described method and the use of the product disclosed herein, a product is obtained which is simple for the end consumer to use for dyeing or refreshing of dyeing of laundry, in particular of jeans or denim materials. In an advantageous manner this provides evidence for the end consumer immediately after implementation of the washing of the occurred effect in the form of the now dye-free product. In particular according to the present disclosure, dark-colored, for example blue or red laundry articles have their dyeing refreshed or their dyeing retained so that fading cannot be detected even after a number of laundry washing processes.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice; material, manufacturing, and assembly tolerances; and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A dye-releasing product for dyeing of or for refreshing of dyeing in textile materials, the dye-releasing product comprising:

a flat, cloth-like carrier material, at least one coating applied onto the cloth-like carrier material and at least one indigoid dye in its oxidized form encompassed by the coating, wherein the coating additionally comprises at least one binding agent for the at least one indigoid dye such that the at least one indigoid dye is released, beginning at a temperature of about 20° C. in an aqueous solution, wherein the coating is soluble, at least in part from the cloth-like carrier material, which is added to the textile material to be dyed or whose dyeing is to be refreshed in a washing process.

2. The dye-releasing product according to claim 1, wherein the at least one binding agent is selected from a group consisting of natural resins and synthetic resins.

3. The dye-releasing product according to claim 2, wherein the at least one binding agent comprises a natural resin selected from the group consisting of gum arabic, guar gum, gelatins, dextrins, agar agar, alginic acid, alginates, carrageenan, albumin, gellan gum, carob bean gum, pectin, modified cellulose, starches, modified starches, xanthan gum and combinations thereof.

4. The dye-releasing product according to claim 2, wherein the at least one binding agent comprises a synthetic resin selected from the group consisting of polyesters, polyvinyl acetates, polyacrylates, polyglycols, polyvinyl alcohols, polyvinyl pyrrolidones and combinations thereof, wherein the synthetic resins are dye-adsorbing synthetic resins.

5. The dye-releasing product according to claim 1, wherein the at least one binding agent is present in an amount in a range from about 1 wt-% to about 50 wt-% relative to the total amount of the coating.

6. The dye-releasing product according to claim 1, wherein the coating comprises at least two binding agents, wherein a first binding agent features a pH-value in a range from about 3.5 up to about 5.5 and a second binding agent features a pH-value in a range from about 5.6 up to about 9.

7. The dye-releasing product according to claim 1, wherein the at least one binding agent is non-ionogenic.

8. The dye-releasing product according to claim 1, wherein the at least one indigoid dye in oxidized form is selected from a group comprising of indigo, indigo-ruby, indigo carmine, purple, and their derivates.

9. The dye-releasing product according to claim 1, wherein the at least one indigoid dye in oxidized form is present in an amount in a range from about 30 wt-% to about 98 wt-% relative to the total amount of the coating.

10. The dye-releasing product according to claim 1, wherein the at least one indigoid dye in oxidized form features a particle size in a range of less than or equal to about 1.5 μm.

11. The dye-releasing product according to claim 1, wherein the coating comprises at least one thickening agent.

12. The dye-releasing product according to claim 1, wherein the cloth-like carrier material is a bonded fiber fabric.

13. The dye-releasing product according to claim 1, wherein the cloth-like carrier material is a viscose-polyester bonded fiber fabric.

14. The dye-releasing product according to claim 1, wherein the cloth-like carrier material is not dyed by the at least one indigoid dye in oxidized form.

15. A method for dyeing of or refreshing of dyeing in textile materials, the method comprising:

adding a dye-releasing product into a washing machine with textile materials, the dye-releasing product comprising:

a flat, cloth-like carrier material, at least one coating applied onto the cloth-like carrier material and at least one indigoid dye in its oxidized form encompassed by the coating, wherein the coating additionally comprises at least one binding agent for the at least one indigoid dye such that the at least one dye is released, beginning at a temperature of about 20° C. in an aqueous solution, wherein the coating is soluble, at least in part from the cloth-like carrier material, which is added to the textile material to be dyed or whose dyeing is to be refreshed in a washing process; and adding an aqueous solution into the washing machine, wherein the dye-releasing product dyes or refreshes dye in the textile materials when the aqueous solution is at a temperature of at least 20° C. and the dye-releasing product is in the aqueous solution for a time period of at least 10 minutes.

16. The method according to claim 15, wherein the pH-value of the aqueous solution is in a range from about 7 to about 13.

17. The method according to claim 15, wherein the textile materials are made of cotton, natural fibers, and/or polyamide and the coating is soluble at least in part from the cloth-like carrier material in a washing process.

18. The method according to claim 15, wherein the coating is soluble at least in part from the cloth-like carrier material in a washing process.

19. The method according to claim 15 further comprising adding a detergent to the aqueous solution and washing the textiles for at least 10 minutes and wherein the cloth-like carrier material is white after washing of the textiles for at least 10 minutes.

20. The method according to claim 15, wherein the textile materials are jeans.

* * * * *